United States Patent [19]

Ekowicki

[11] 4,222,024

[45] Sep. 9, 1980

[54] THERMISTOR ASSEMBLY

[75] Inventor: Robert L. Ekowicki, Westbrook, Me.

[73] Assignee: GTE Sylvania Incorporated, Stamford, Conn.

[21] Appl. No.: 7,099

[22] Filed: Jan. 29, 1979

[51] Int. Cl.[2] ..... H01C 7/04

[52] U.S. Cl. ..... 338/22 R; 29/612

[58] Field of Search ..... 338/22 R, 22 SD, 23, 338/25, 28; 29/612, 613; 73/362 AR

[56] References Cited

U.S. PATENT DOCUMENTS

| | | | |
|---|---|---|---|
| 3,876,861 | 4/1975 | Wightman et al. | 338/22 SD X |
| 3,911,386 | 10/1975 | Beaudoin et al. | 338/23 X |
| 3,933,028 | 1/1976 | Laud et al. | 338/23 X |
| 3,955,170 | 5/1976 | Geishecker | 338/22 SD |

OTHER PUBLICATIONS

Bar, German Printed Publication 2729126, 6/77.

*Primary Examiner*—C. L. Albritton

*Attorney, Agent, or Firm*—James Theodosopoulos

[57] ABSTRACT

The thermistor assembly comprises a thermistor disc disposed within a closed ceramic container which has a support arm fastened thereto.

3 Claims, 3 Drawing Figures

THERMISTOR ASSEMBLY

THE INVENTION

This invention is concerned with ceramic thermistors, such as are shown in U.S. Pat. No. 4,079,350. It is particularly concerned with a thermistor assembly suitable for mounting. Thermistors are often encapsulated in plastic, as shown in U.S. Pat. Nos. 3,824,328, 3,996,447 and 4,079,350, for protection and/or thermal conductivity. A disadvantage to the use of such material is its flammability. In some applications, it is desirable that the thermistor be contained within a nonflammable container in order to prevent ignition thereof in the event of thermistor malfunction. In this invention, the thermistor is enclosed within a nonflammable container. Although it is known to enclose a thermistor in a nonflammable material such as glass tubing, see for example U.S. Pat. No. 3,767,597, glass does not readily lend itself to formation into desired container shapes nor does it readily provide means for spacing a thermistor therewithin nor for anchoring a mechanical support arm for the thermistor assembly.

A thermistor assembly in accordance with this invention comprises a ceramic thermistor within a ceramic case, the case having means to hold the thermistor therewithin. The case also has means securing a mechanical support arm thereto.

Figure 1:
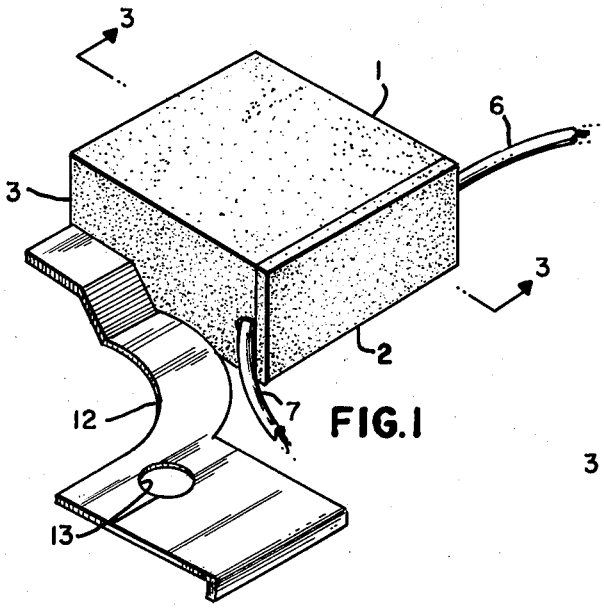
Figure 3:
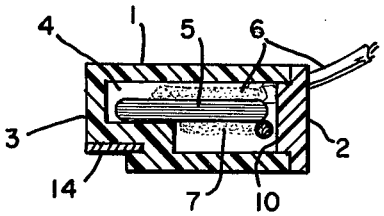
Figure 2:
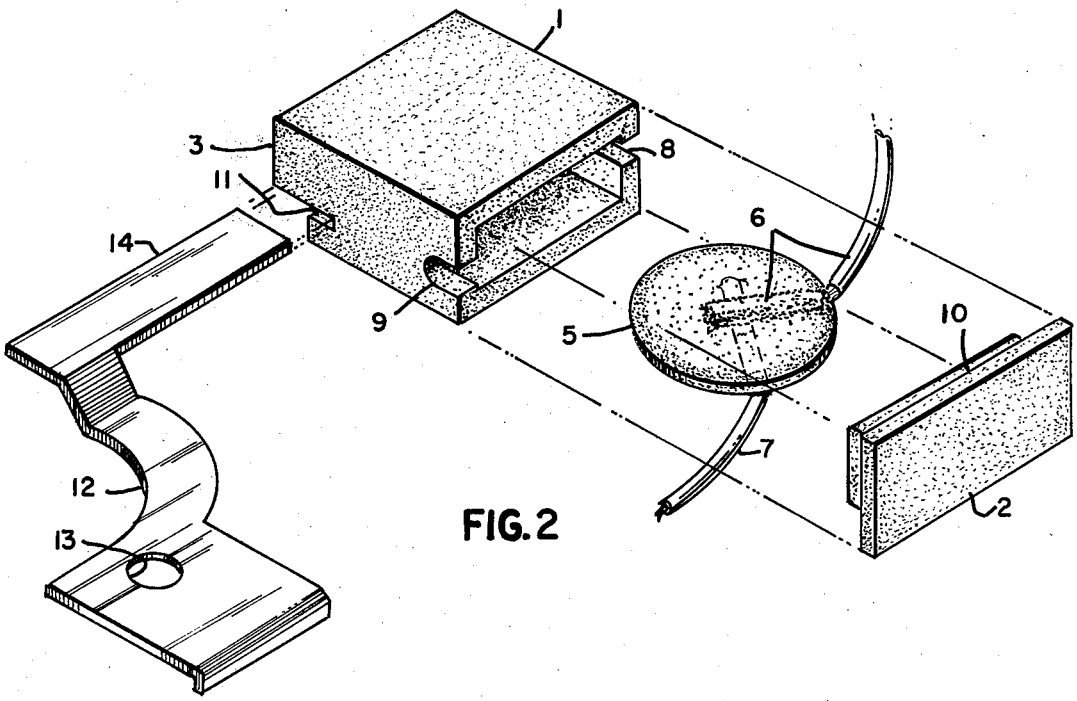

In the drawing, FIG. 1 is a perspective view and FIG. 2 is an exploded view of a thermistor assembly in accordance with this invention. FIG. 3 is a sectional view along line 3—3 of FIG. 1.

In a preferred embodiment, the thermistor assembly comprised a generally rectangular ceramic case 1 open at one end which was sealed by ceramic cover 2 bonded thereto by cement. The other end 3 of case 1 was thinner than the main body thereof to provide a narrow pocket 4 into which thermistor disc 5 could slip fit. Lead-in wires 6 and 7 were attached to opposite faces of disc 5 and extended out through openings 8 and 9 in the walls of case 1. Cover 2 had a raised surface 10 thereon which fit inside case 1. Raised surface 10 improved the strength of the cement bond of cover 2 to case 1 and also restricted movement of disc 5 within case 1. Case 1 had an external slot 11 into which one end 14 of support arm 12 was secured. A hole 13 was provided at the other end of support arm 12 for attaching the thermistor assembly to the apparatus in which it was used.

In one example, the external width of case 1 was 0.75 inches and its length with cover 2 sealed thereto was 0.78 inches. The main body depth was 0.37 inches and the depth at narrow end 3 was 0.26 inches. Disc 5 was 0.54 inches in diameter by 45 mils thick. Lead-in wires 6 and 7 were 20 gauge stranded copper wire, but when soldered to disc 5 had an effective thickness of about 34 mils. Thus when disc 5 was inserted into pocket 4 the thickness of lead-in wire 6 substantially prevented intimate contact of disc 5 with case 1. Spacing of disc 5 from case 1 decreased thermal conductivity thereto and was desirable, since the thermistor assembly was used to reduce current flow through a solenoid from 5 amperes to 150 milliamperes in a short period of time. Lack of heat-sinking of the greater part of disc 5 reduced the time necessary to reduce current flow. Support arm 12 was made of zinc-plated steel 31 mils thick and although it was a tight fit in external slot 11, the attachment was further secured by the use of cement.

What I claim as new is:

1. A thermistor assembly comprising a thermistor disc disposed within a closed ceramic container, means on said ceramic container securing a support arm thereto, lead-in wires attached to said disc and extending out through openings in said container, the greater part of said disc being spaced from said container in order to minimize heat transfer from said disc to said container, one end of said container being narrower than the other and forming a pocket into which said disc slip fits.

2. The assembly of claim 1 wherein said ceramic container comprises a ceramic case and a ceramic cover secured thereto, the ceramic cover having a raised surface thereon which extends into said case and which aids in restricting movement of said disc within said container.

3. The assembly of claim 1 wherein one end of said container has an external slot into which said support arm is secured.

* * * * *